US005526584A

United States Patent [19]

Bleimhofer et al.

[11] Patent Number: 5,526,584

[45] Date of Patent: Jun. 18, 1996

[54] SOCK-LIKE SHOE INSERT

[76] Inventors: Walter Bleimhofer; Rita Danielak, both of Stetten 11a, 8201 Ostermünchen, Germany

[21] Appl. No.: 326,688

[22] Filed: Jan. 10, 1994

Related U.S. Application Data

[63] Continuation of Ser. No. 964,340, Oct. 21, 1992, abandoned.

[51] Int. Cl.[6] ..... A43B 17/10; A43B 23/07

[52] U.S. Cl. ..... 36/10.000; 36/55

[58] Field of Search ..... 36/9 R, 10, 55, 36/93; 2/239

[56] References Cited

U.S. PATENT DOCUMENTS

| | | | |
|---|---|---|---|
| 2,679,117 | 5/1954 | Reed | 36/9 R |
| 2,845,723 | 8/1958 | Arnold | 36/9 R |
| 3,289,328 | 8/1965 | Abel . | |
| 3,793,746 | 2/1974 | Mitchell et al. | 36/87 |
| 3,866,245 | 2/1975 | Sutherland . | |
| 4,110,392 | 8/1978 | Yamasaki . | |
| 4,194,041 | 3/1980 | Gore et al. . | |
| 4,276,671 | 7/1981 | Melton | 36/9 R X |
| 4,327,057 | 2/1983 | Nielsen | 36/43 X |
| 4,550,446 | 11/1985 | Herman | 2/239 |
| 4,599,810 | 7/1986 | Sacre . | |
| 4,809,447 | 3/1989 | Pacanowsky et al. | 36/9 R |
| 4,819,345 | 4/1989 | Mulcahy et al. . | |

FOREIGN PATENT DOCUMENTS

| | | |
|---|---|---|
| 334038 | 2/1989 | European Pat. Off. . |
| 1228239 | 8/1960 | France . |
| 2116790 | 12/1970 | France . |
| 787148 | 10/1949 | Germany . |
| 20586 | 5/1955 | Germany . |
| 1096324 | 1/1958 | Germany . |
| 1924306 | 12/1961 | Germany . |
| 1850326 | 12/1961 | Germany . |
| 1248006 | 8/1963 | Germany . |
| 2123316 | 5/1970 | Germany . |
| 2551233 | 2/1974 | Germany . |
| 2711579 | 3/1977 | Germany . |
| 2737756 | 8/1977 | Germany . |
| 2854464 | 12/1978 | Germany . |
| 149459 | 7/1981 | Germany . |
| 284638 | 4/1987 | Germany . |
| 3840087 | 11/1988 | Germany . |
| 3840263 | 11/1988 | Germany . |
| 8814974 | 12/1988 | Germany . |
| 330974 | 2/1989 | Germany . |
| 4007962 | 3/1990 | Germany . |
| 9004403 | 4/1990 | Germany . |
| 167792 | 11/1975 | Italy . |
| 70430 | 5/1946 | Norway . |

OTHER PUBLICATIONS

Purchase Order–Early Winters, Ltd. to Danner Boot Co., Jun. 20, 1980.

Recreational Equipment, Inc. Catalogue, p. 28, Spring, 1980.

Danner Shoe Mfg. Co. Shipping Invoice, Aug. 28, 1980.

Danner Shoe Mfg. Co. Shipping Invoice, Oct. 14, 1980.

P. Sroka and K. Stukenbrook, Harbuch der Textilen Fixiereinlagen, Sections 1.1, 1.2, 1.3 and 6 (1980), (Sinus Publishers) (with translation).

F. J. Fleissner, Der Weg zum Cheimodelleur, (1955) (Schuhindustrie–Verlag Seiler & Co.) (with translation).

Romika Order Book 1970/71 Fall/Winter, 1, 2, 72 (with translation).

Romika Order Book 1972/73 Fall/Winter, 1, 2, 25 (with translation).

Drawing of Nov. 30, 1989 (with translation).

Golke and Tanner, GORE–TEX® Waterproof Breathable Laminates, vol. 6, J. Coated Fabrics 28–37 (Jul. 1976).

Harold Rose, Fusible Interlinings—Origins and Technology; 1–10 (Highgate Publications).

*Primary Examiner*—Paul T. Sewell
*Assistant Examiner*—Ted Kavanaugh
*Attorney, Agent, or Firm*—Gary A. Samuels

[57] ABSTRACT

A sock-like shoe insert is provided which incorporates an upper of waterproof, water-vapor permeable functional layer for waterproof, breathable footwear and a sole of a waterproof, non-porous plastic film that can be stretched in two directions.

8 Claims, 2 Drawing Sheets

SOCK-LIKE SHOE INSERT

This application is a continuation, of application Ser. No. 07/964,340 filed Oct. 21, 1992, now abandoned.

FIELD OF THE INVENTION

The invention relates to a sock-like shoe insert which incorporates an upper having a waterproof, water vapor permeable functional layer for waterproof, breathable footwear, and a sole of waterproof, non-porous plastic film that can be stretched in two directions.

BACKGROUND OF THE INVENTION

The waterproof, breathable footwear consists of an upper which is air-permeable but at the same time water permeable. The outer layer of the upper may be a leather or a textile fabric. The waterproofness is achieved through the use of a waterproof water-vapor permeable functional layer that is arranged within the shoe. The functional layer may be made of expanded microporous polytetrafluoroethylene (PTFE). It is difficult to sew the functional layer directly to the upper and/or sole material of the footwear. The functional layer becomes permeable to water when it is pierced during the sewing process. A common method is therefore to provide the footwear with a sock-like shoe insert containing the functional layer. The latter is usually part of a laminate which comprises the functional layer and a textile material, at least on one side of the functional layer, preferably at both sides of the functional layer. The sock-like shoe insert incorporates several pieces which may be joined to produce a waterproof upper and sole part. This waterproof joining process may be accomplished by sewing the individual pieces together and sealing the seams with a superimposed adhesive or sealing tape which is applied onto the seam by a bonding or welding process.

Such a sock-like shoe insert, which is termed "bootie" by the experts in the field, is preferably attached within the footwear in that the upper end of the shoe insert is connected with the upper end of the footwear, by sewing, and that the sole area of the shoe insert is held stationary between the outsole and the insole of the footwear, preferably by adhesive bonding over the entire surface.

Leakage has sometimes been observed immediately after the manufacture of the footwear or after extended use particularly in the sole area.

There is a need for a sock-like shoe insert in which only the upper is provided with the functional layer whereas the sole area consists of a waterproof, non-porous plastic film which is bidirectionally stretchable.

SUMMARY OF THE INVENTION

A sock-like shoe insert is provided having a waterproof water-vapor permeable functional layer for waterproof, breathable footwear, wherein the shoe insert comprises an upper having a functional layer and a sole consisting of a waterproof, non-porous plastic film which can be stretched in two dimensions. The shoe insert parts may be sewn together and then covered by a waterproof seam-sealing tape. The shoe insert parts may also be connected by a sealed seam or an adhesive seam.

The shoe insert sole consisting of the non-porous plastic film may consist of a polyurethane. The polyurethane may also be provided with a two-dimensionally stretchable textile-like material at the inner side of the shoe insert.

The functional layer of the upper may be a laminate comprising the functional layer and a textile layer on at least one side of the functional layer. The functional layer may be formed of a film of expanded microporous polytetrafluoroethylene.

The shoe insert may also have an insole that is adhesively bonded to the inner side of the sole area.

DETAILED DESCRIPTION OF THE PREFERRED EMBODIMENTS

Figure 1:
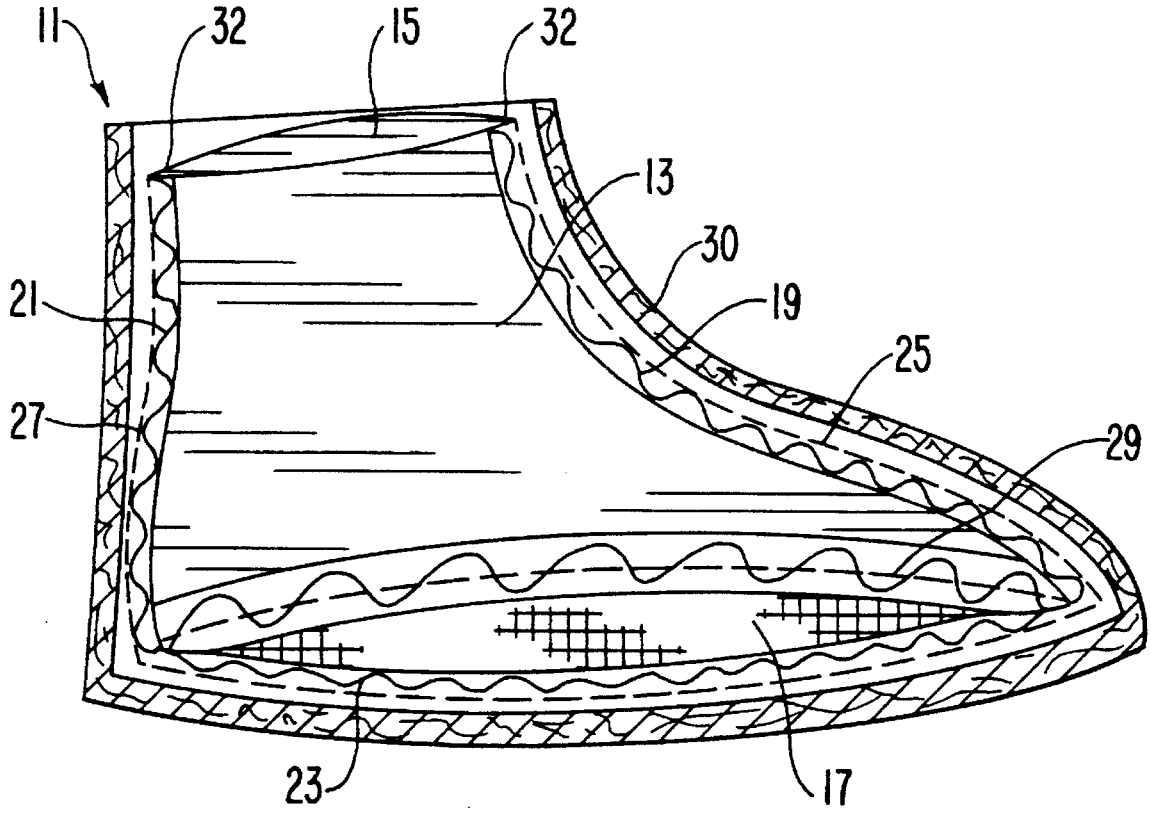
FIG. 1 is a schematic view of a bicomponent bootie in combination with a waterproof breathable footwear shown in cross-section as provided by the present invention.

The first step in designing the features of the present invention includes an analysis of existing state of the art footwear. This analysis includes the following:

1. While walking, the human foot expands both in the walking direction and in the cross direction, (i.e. in two directions). The functional layer of which the standard insert usually consist is, however, stretchable in one direction only. This applies in particular to functional layer laminates, the functional layer of which is provided with a textile carrier material, at least on one side. Such textile carrier materials usually consist of knit or woven materials, which stretch differently in the warp and weft direction. As a result, the elasticity of the laminate differs, depending on the stretching direction; in most cases the stretchability is monoaxial only.

Due to this monoaxial stretchability, the bootie may be subjected to considerable mechanical stress which cannot be compensated for by the elasticity of the bootie material, in particular in the sole area where a cut sole piece is connected with upper pieces of the bootie.

2. Lasting is a common procedural step during the manufacture of shoes. In this process, the upper is applied around a last, turned back so that it overlaps the sole edges of the last and is attached to an insole which is mounted to the sole of the last. During this process, the bootie is located between the insole and the turned back upper material. The three-dimensional shape of the last causes wrinkles to be formed during the lasting process. These wrinkles occur in the upper but also in the laminate containing the functional layer, in particular in the sole area, at the heel. This leads to pressure peaks at these wrinkles, which may damage the functional layer.

Since the upper is pulled around the transitional area between the sole and the leg of the last under a high tension, the sole area of the bootie laminate is subjected to high pressures, which may also damage the functional layer. In order to maintain the breathability of the laminate with the functional layer, the individual layers of the laminate are bonded by means of adhesive dots applied in a matrix-like distribution. Furthermore, the textile laminate layers are often ribbed to a certain extent. At the small areas where the adhesive dots and the ribbed surfaces are located, the full pressure exerted by the lasting process is transmitted to the functional layer. Even worse, the laminate is stretched by up to 20% while being subjected to the pressure force.

3. The different layers of the laminate shrink nonuniformly when subjected to elevated temperatures, which results in a forced expansion and stress of the functional layer in the laminate composite. As a consequence, shrinkage wrinkles may be produced on the functional layer outside of the adhesive matrix dots. When the shrinkage wrinkles are subjected to pressure, they are more likely to be damaged than the wrinkle-free parts.
4. The individual cut pieces of the bootie are connected with each other by seams. Subsequently, the seams are sealed using a sealing tape applied by means of hot air. When the seams are sealed, the bootie is deformed, because it is exposed to the elevated sealing temperature and because the laminate is manually fed into the seam sealing machine.
5. Whereas the above-mentioned reasons may damage the functional layer of a bootie during the production stage, other kinds of damage may occur while the shoe is being worn. One example is that fine sand may enter the space between the inlay sole and the laminate and destroy the functional layer due to the pressure exerted by the wearer's weight.

The present invention addresses many of these problems. Since the sole area does not contain a functional layer but a waterproof, non-porous plastic film which is stretchable in two dimensions, the bootie can be constructed in such a way that waterproofness and mechanical strength are assured. The present invention is referred to as a bicomponent bootie.

A flat film consisting of thermoplastic polyurethane elastomers is the preferred material for the sole area of a bicomponent bootie. Preferably an extruded flat film is used.. The preferred wall thickness ranges from 0.25 to 1 mm. Thermoplastic polyurethane elastomers in the form of highly molecular organic materials of segmented (i.e. alternating hard and soft segments) and predominantly linear construction are preferred. The preferred shore hardness values are in the range of 86 A.

Such plastic films excel by their high mechanical strength, high wear resistance, flexibility over a wide temperature range, good seam-sealability and high two-directional stretchability.

A bicomponent bootie according to the present invention has an improved fit and a homogenous distribution of the extension in all directions of the sole area. The sole area is protected against damage. The higher elasticity of the bicomponent bootie in the sole area leads to decreased expansion in the remaining part of the bootie laminate. The bicomponent bootie provided is waterproof because the weak parts of previous footwear have been eliminated.

In a preferred embodiment of the invention, the upper and the sole area are sewn together and the seams are covered by a waterproof seam-sealing tape. Alternatively the individual cut pieces of the bicomponent bootie may be connected with each other through sealed seams or adhesive seams.

The inner side of the plastic film used in the sole of the bicomponent bootie described in the present invention may be provided with a bidirectionally stretchable, textile-like material, and may consist of a polyamide which has additional moisture absorption capacities.

Usually, booties are not made by the shoe manufacturers but by the suppliers of functional layer materials. It is therefore advantageous to adhesively bond an insole into the bootie at the bootie manufacturer's plant. This will simplify the subsequent production of the shoes for the shoe manufacturer. The following materials are suitable for the functional layer: microporous expanded polytetrafluoroethylene (PTFE), as described in the U.S. Pat. Nos. 3,953,566 and 4,187,390, expanded PTFE provided with hydrophilic impregnation agents and/or layers as described in U.S. Pat. No. 4,194,041, breathable polyurethane layers, or elastomers such as copolyetherester and laminates thereof, as described in U.S. Pat. Nos. 4,725,481 and 4,493,870. All of these cited patents are hereby incorporated by reference.

The invention is best understood by reference to the accompanying drawings.

FIG. 1 is a schematic drawing of a bicomponent bootie 11 which consists of a lateral upper section 13 shown as the front part in FIG. 1, a lateral upper section 15 shown as the rear part in FIG. 1 and a sole part 17. The two lateral upper sections 13 and 15 are linked by an instep seam 19 and a heel seam 21 to produce a bootie leg. This bootie leg is linked with the sole part 17 through a sole seam 23. The seams 19, 21 and 23 are covered by a waterproof instep seam tape 25, a heel seam tape 27 and a sole seam tape 29. These seam-sealing tapes are usually applied by means of hot air to form a bond with the material to be sealed.

The lateral upper sections 13 and 15 consist of a laminate with a functional layer which is provided with a textile layer, at least on one side, in order to increase the mechanical strength. The laminate may be provided with a textile layer on both sides. In this case, the inner textile layer may be formed by a material which absorbs moisture.

The sole part 17 preferably consists of a polyurethane film of about the same dimensions as the insole of the footwear to be provided with the bicomponent bootie. Polyurethane films with the above-mentioned properties and parameters are preferred.

The bicomponent bootie is attached within a waterproof breathable footwear 30 in that the upper end of the bootie is connected with the upper end of the footwear, by sewing 32, and that the sole area of the bootie is held stationary between the outsole and the insole of the footwear, preferably by adhesive bonding over the entire surface.

Figure 2:
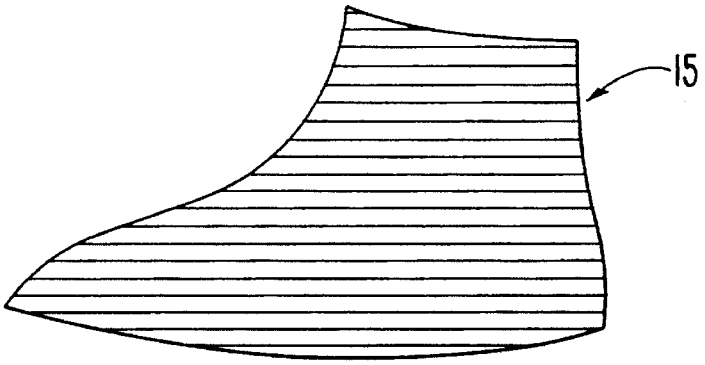
FIGS. 2 through 4 are cut parts comprised in the bicomponent bootie according to FIG. 1, namely two cut parts for the leg in FIGS. 2 and 3 and one cut part for the sole in FIG. 4.
Figure 3:
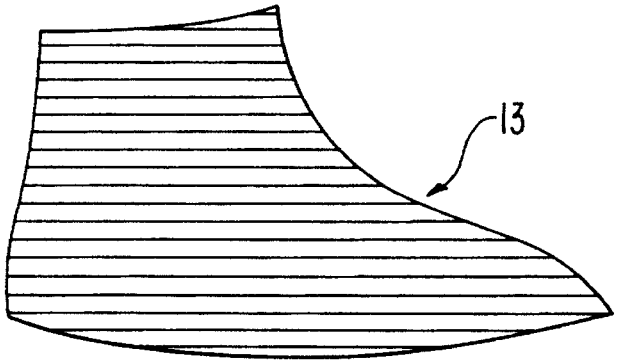
Figure 4:
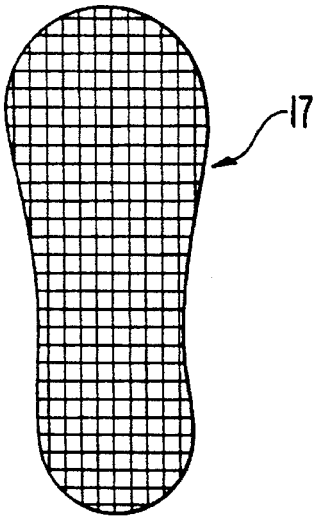

FIGS. 2 and 3 show the two lateral upper sections 15 and 13. FIG. 4 shows the sole part 17.

The fit may be improved if the upper of the bicomponent bootie comprises more than the two upper sections 13 and 15. The upper section of the bicomponent bootie is preferably made from three upper sections-two lateral upper sections and one wedge-shaped instep part which extends from the toe part of the two-component bootie, where it is narrow, to the upper open end of the bicomponent bootie, where it broadens, and which approximately corresponds to the tongue area of the footwear to be furnished with the bicomponent bootie.

The bicomponent bootie described in the present invention may also be provided with an insole 8 which is applied by the bootie manufacturer to the inner side of the sole area 17 of the bootie as shown in FIGS. 2 and 3, in particular by adhesive bonding. This considerably simplifies the shoe manufacturing process because the shoe manufacturer is supplied with the finished bootie by the bootie manufacturer.

We claim:

1. A bicomponent bootie insert in combination with a waterproof breathable footwear, said bootie insert comprising an upper provided with a laminate having at least an outer textile layer and a functional layer that is waterproof and water vapor permeable and a sole that is a waterproof, nonporous plastic elastomeric film stretchable in two dimensions, wherein the upper and sole of the bootie insert are attached to each other in a waterproof manner and wherein the bootie insert is attached to the waterproof footwear.

2. A bootie insert of claim 1, wherein the upper and the sole are sewn together to form seams and the seams are covered by a waterproof seam-sealing tape.

3. A bootie insert of claim 1, wherein the upper and the sole are connected by a seam selected from the group consisting of welded seams and adhesive seams.

4. A bootie insert of claim 1, wherein the plastic film consists of polyurethane.

5. A bootie insert of claim 1, wherein the plastic film consists of a polyurethane film which is provided with a two-dimensionally stretchable, textile material at an inner side of the shoe insert.

6. A bootie insert of claim 1, wherein the upper consists of a laminate which comprises the functional layer and a textile layer, at least on one side of the functional layer.

7. A bootie insert of claim 1, wherein the functional layer is formed by a film consisting of expanded, microporous polytetrafluoroethylene (PTFE).

8. A bootie insert of claim 1, wherein an insole is adhesively bonded to an inner side of the sole.

* * * * *